US010663894B2

(12) United States Patent
Okamoto et al.

(10) Patent No.: US 10,663,894 B2
(45) Date of Patent: May 26, 2020

(54) FIXING DEVICE AND IMAGE FORMING APPARATUS

(71) Applicant: RICOH COMPANY, Ltd., Ohta-Ku (JP)

(72) Inventors: Jun Okamoto, Tokyo (JP); Yoshio Hattori, Kanagawa (JP); Haruyuki Honda, Kanagawa (JP); Takumi Waida, Kanagawa (JP); Kiwako Hiroi, Gifu (JP); Yuusuke Furuichi, Kanagawa (JP); Tomoya Adachi, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 15/841,383

(22) Filed: Dec. 14, 2017

(65) Prior Publication Data

US 2018/0203384 A1 Jul. 19, 2018

(30) Foreign Application Priority Data

Jan. 17, 2017 (JP) ..... 2017-005662

(51) Int. Cl.
*G03G 15/20* (2006.01)

(52) U.S. Cl.
CPC ..... *G03G 15/2025* (2013.01); *G03G 15/2053* (2013.01)

(58) Field of Classification Search
CPC ..... G03G 15/2025; G03G 15/2075; G03G 15/2053; G03G 15/2064; G03G 2215/2035
See application file for complete search history.

(56) References Cited

U.S. PATENT DOCUMENTS 5,300,996 A 4/1994 Yokoyama et al.
5,648,842 A 7/1997 Sekine et al.
(Continued)

FOREIGN PATENT DOCUMENTS

CN 101799655 A 8/2010
CN 102566379 A 7/2012
(Continued)

OTHER PUBLICATIONS

Chinese Office Action dated Mar. 30, 2020, issued in corresponding Chinese Patent Application No. CN201810021529.X, 7 pages.

*Primary Examiner* — Walter L Lindsay, Jr.
*Assistant Examiner* — Jessica L Eley
(74) *Attorney, Agent, or Firm* — Xsensus LLP

(57) ABSTRACT

A fixing device includes a fixing belt and a pressure rotator that presses against a nip formation pad via the fixing belt to form a fixing nip between the pressure rotator and the fixing belt. A first holder holds a first lateral end of the fixing belt in an axial direction thereof. A second holder holds a second lateral end of the fixing belt in the axial direction thereof. The second holder, together with the first holder, defines a holder interval provided between the first holder and the second holder in the axial direction of the fixing belt. A lubricant supplying sheet impregnated with a lubricant is sandwiched between the nip formation pad and the fixing belt at the fixing nip. The lubricant supplying sheet has a sheet span in the axial direction of the fixing belt. The sheet span is within the holder interval.

19 Claims, 4 Drawing Sheets

(56) References Cited

U.S. PATENT DOCUMENTS

| | | | | |
|---|---|---|---|---|
| 5,678,153 | A | 10/1997 | Okamoto et al. | |
| 5,679,462 | A | 10/1997 | Soga et al. | |
| RE36,124 | E | 3/1999 | Yokoyama et al. | |
| 8,498,561 | B2 * | 7/2013 | Yamaguchi | G03G 15/2064 399/122 |
| 8,682,218 | B2 * | 3/2014 | Yamaguchi | G03G 15/2046 399/122 |
| 2007/0170211 | A1 | 7/2007 | Hattori | |
| 2007/0292175 | A1 | 12/2007 | Shinshi | |
| 2009/0274485 | A1 | 11/2009 | Adachi et al. | |
| 2010/0202809 | A1 | 8/2010 | Shinshi et al. | |
| 2011/0052282 | A1 * | 3/2011 | Shinshi | G03G 15/2064 399/329 |
| 2011/0062835 | A1 | 3/2011 | Idehara et al. | |
| 2012/0155936 | A1 | 6/2012 | Yamaguchi et al. | |
| 2013/0195523 | A1 * | 8/2013 | Yamaji | G03G 15/2053 399/329 |
| 2013/0195524 | A1 * | 8/2013 | Ishii | G03G 15/206 399/329 |
| 2015/0248090 | A1 * | 9/2015 | Yamamoto | G03G 15/2053 399/122 |
| 2016/0098000 | A1 | 4/2016 | Furuichi et al. | |
| 2016/0116869 | A1 | 4/2016 | Saito et al. | |
| 2016/0124359 | A1 | 5/2016 | Ikebuchi et al. | |
| 2016/0154350 | A1 | 6/2016 | Saito et al. | |
| 2016/0187822 | A1 | 6/2016 | Fukuhata et al. | |
| 2016/0274508 | A1 | 9/2016 | Honda et al. | |
| 2016/0274509 | A1 | 9/2016 | Honda et al. | |
| 2016/0274513 | A1 | 9/2016 | Yamaguchi et al. | |
| 2016/0274515 | A1 * | 9/2016 | Imada | G03G 15/2053 |
| 2016/0274516 | A1 | 9/2016 | Yamaguchi et al. | |
| 2016/0274523 | A1 | 9/2016 | Mimbu et al. | |
| 2016/0349677 | A1 | 12/2016 | Okamoto | |
| 2016/0378028 | A1 | 12/2016 | Fujiwara et al. | |
| 2017/0097599 | A1 | 4/2017 | Fukuhata et al. | |
| 2017/0108807 | A1 | 4/2017 | Furuichi et al. | |
| 2017/0115610 | A1 * | 4/2017 | Yoshiura | G03G 15/2025 |
| 2017/0176899 | A1 | 6/2017 | Okamoto et al. | |
| 2017/0185019 | A1 | 6/2017 | Seo et al. | |
| 2017/0343942 | A1 | 11/2017 | Okamoto et al. | |

FOREIGN PATENT DOCUMENTS

| | | | |
|---|---|---|---|
| JP | 2001-109289 | | 4/2001 |
| JP | 2003-282230 | | 10/2003 |
| JP | 2005300732 | A | 10/2005 |
| JP | 2006-065250 | | 3/2006 |
| JP | 2007-334205 | | 12/2007 |
| JP | 2009-109697 | | 5/2009 |
| JP | 2009-134074 | | 6/2009 |
| JP | 2010-204587 | | 9/2010 |
| JP | 2013-174629 | | 9/2013 |
| JP | 2017-111332 | | 6/2017 |
| JP | 2017-111333 | | 6/2017 |

* cited by examiner

FIXING DEVICE AND IMAGE FORMING APPARATUS

CROSS-REFERENCE TO RELATED APPLICATION

This patent application is based on and claims priority pursuant to 35 U.S.C. § 119 to Japanese Patent Application No. 2017-005662, filed on Jan. 17, 2017, in the Japanese Patent Office, the entire disclosure of which is hereby incorporated by reference herein.

BACKGROUND

Technical Field

Exemplary aspects of the present disclosure relate to a fixing device and an image forming apparatus, and more particularly, to a fixing device for fixing a toner image on a recording medium and an image forming apparatus incorporating the fixing device.

Description of the Background

Related-art image forming apparatuses, such as copiers, facsimile machines, printers, or multifunction printers having two or more of copying, printing, scanning, facsimile, plotter, and other functions, typically form an image on a recording medium according to image data. Thus, for example, a charger uniformly charges a surface of a photoconductor; an optical writer emits a light beam onto the charged surface of the photoconductor to form an electrostatic latent image on the photoconductor according to the image data; a developing device supplies toner to the electrostatic latent image formed on the photoconductor to render the electrostatic latent image visible as a toner image; the toner image is directly transferred from the photoconductor onto a recording medium or is indirectly transferred from the photoconductor onto a recording medium via an intermediate transfer belt; finally, a fixing device applies heat and pressure to the recording medium bearing the toner image to fix the toner image on the recording medium, thus forming the image on the recording medium.

Such fixing device may include a fixing rotator, such as a fixing roller, a fixing belt, and a fixing film, heated by a heater and a pressure rotator, such as a pressure roller and a pressure belt, pressed against the fixing rotator to form a fixing nip therebetween through which a recording medium bearing a toner image is conveyed. As the recording medium bearing the toner image is conveyed through the fixing nip, the fixing rotator and the pressure rotator apply heat and pressure to the recording medium, melting and fixing the toner image on the recording medium.

SUMMARY

This specification describes below an improved fixing device. In one embodiment, the fixing device includes a fixing belt rotatable in a rotation direction and a nip formation pad disposed opposite an inner circumferential surface of the fixing belt. A pressure rotator presses against the nip formation pad via the fixing belt to form a fixing nip between the pressure rotator and the fixing belt, through which a recording medium is conveyed. A first holder holds a first lateral end of the fixing belt in an axial direction of the fixing belt. A second holder holds a second lateral end of the fixing belt in the axial direction of the fixing belt. The second holder, together with the first holder, defines a holder interval provided between the first holder and the second holder in the axial direction of the fixing belt. A lubricant supplying sheet is impregnated with a lubricant and sandwiched between the nip formation pad and the fixing belt at the fixing nip. The lubricant supplying sheet has a sheet span in the axial direction of the fixing belt. The sheet span is within the holder interval.

This specification further describes an improved image forming apparatus. In one embodiment, the image forming apparatus includes an image forming device to form a toner image and a fixing device to fix the toner image on a recording medium. The fixing device includes a fixing belt rotatable in a rotation direction and a nip formation pad disposed opposite an inner circumferential surface of the fixing belt. A pressure rotator presses against the nip formation pad via the fixing belt to form a fixing nip between the pressure rotator and the fixing belt, through which the recording medium is conveyed. A first holder holds a first lateral end of the fixing belt in an axial direction of the fixing belt. A second holder holds a second lateral end of the fixing belt in the axial direction of the fixing belt. The second holder, together with the first holder, defines a holder interval provided between the first holder and the second holder in the axial direction of the fixing belt. A lubricant supplying sheet is impregnated with a lubricant and sandwiched between the nip formation pad and the fixing belt at the fixing nip. The lubricant supplying sheet has a sheet span in the axial direction of the fixing belt. The sheet span is within the holder interval.

BRIEF DESCRIPTION OF THE DRAWINGS

A more complete appreciation of the embodiments and many of the attendant advantages and features thereof can be readily obtained and understood from the following detailed description with reference to the accompanying drawings, wherein.

Figure 1:
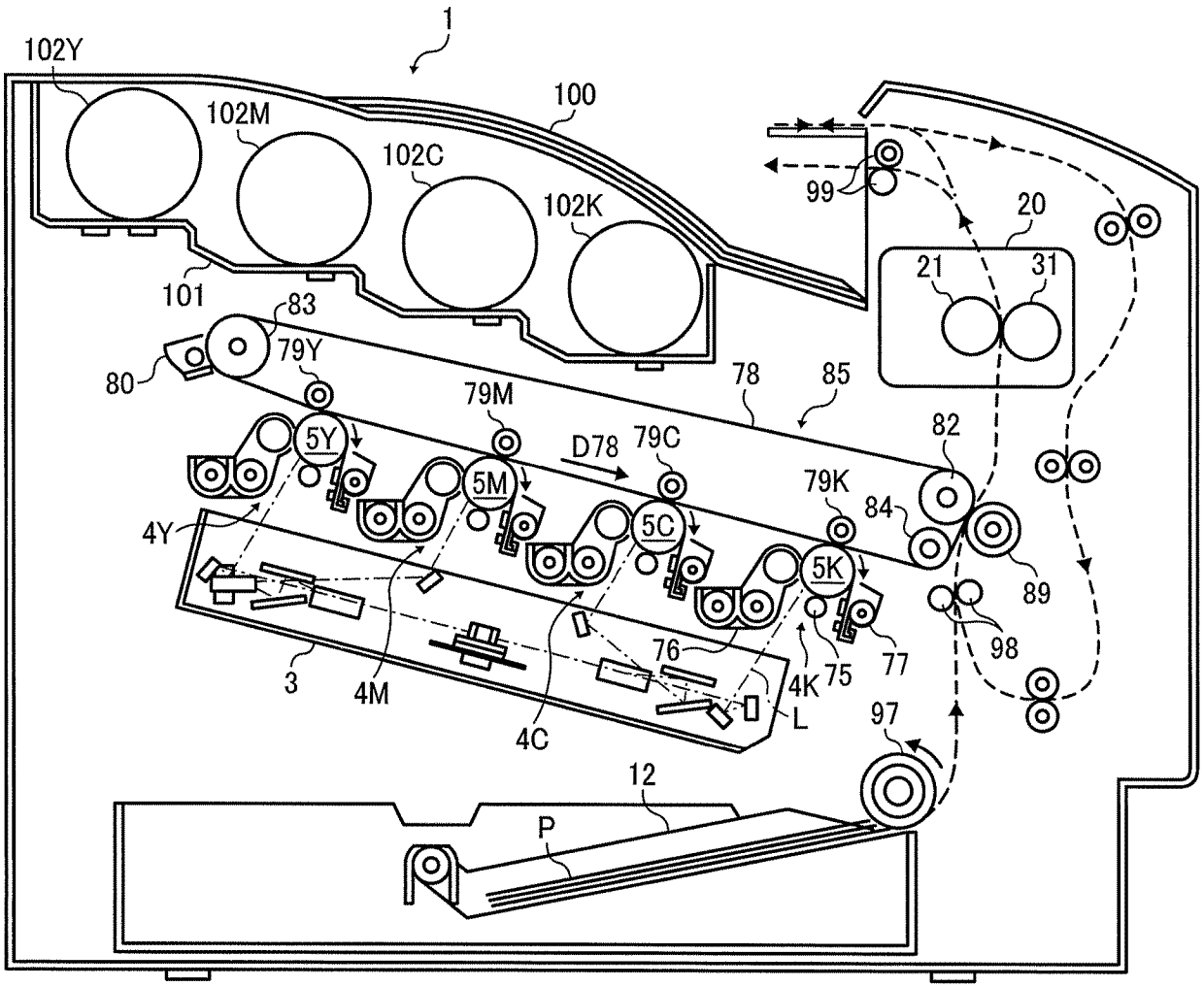
FIG. 1 is a schematic vertical cross-sectional view of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION OF THE DISCLOSURE

In describing embodiments illustrated in the drawings, specific terminology is employed for the sake of clarity.

However, the disclosure of this specification is not intended to be limited to the specific terminology so selected and it is to be understood that each specific element includes all technical equivalents that have a similar function, operate in a similar manner, and achieve a similar result.

As used herein, the singular forms "a", "an", and "the" are intended to include the plural forms as well, unless the context clearly indicates otherwise.

Referring now to the drawings, wherein like reference numerals designate identical or corresponding parts throughout the several views, particularly to FIG. 1, an image forming apparatus 1 according to an embodiment is explained.

FIG. 1 is a schematic vertical cross-sectional view of the image forming apparatus 1. The image forming apparatus 1 may be a copier, a facsimile machine, a printer, a multifunction peripheral or a multifunction printer (MFP) having at least two of copying, printing, scanning, facsimile, and plotter functions, or the like. According to this embodiment, the image forming apparatus 1 is a color printer that forms a color toner image on a recording medium by electrophotography. Alternatively, the image forming apparatus 1 may be a monochrome printer that forms a monochrome toner image on a recording medium.

Identical reference numerals are assigned to identical components or equivalents and a description of those components is simplified or omitted.

Referring to FIG. 1, a description is provided of a construction and an operation of the image forming apparatus 1.

As illustrated in FIG. 1, the image forming apparatus 1 is a tandem color printer. In an upper portion of the image forming apparatus 1 is a bottle housing 101 that accommodates four toner bottles 102Y, 102M, 102C, and 102K containing fresh yellow, magenta, cyan, and black toners, respectively, and being detachably attached to the bottle housing 101 for replacement.

Below the bottle housing 101 is an intermediate transfer unit 85. The intermediate transfer unit 85 includes an intermediate transfer belt 78 disposed opposite four image forming devices 4Y, 4M, 4C, and 4K, arranged along the intermediate transfer belt 78, that form yellow, magenta, cyan, and black toner images, respectively.

The image forming devices 4Y, 4M, 4C, and 4K include photoconductive drums 5Y, 5M, 5C, and 5K, respectively. Each of the photoconductive drums 5Y, 5M, 5C, and 5K is surrounded by a charger 75, a developing device 76, a cleaner 77, a discharger, and the like. Image forming processes including a charging process, an exposure process, a developing process, a primary transfer process, and a cleaning process are performed on an outer circumferential surface of each of the photoconductive drums 5Y, 5M, 5C, and 5K, forming yellow, magenta, cyan, and black toner images on the photoconductive drums 5Y, 5M, 5C, and 5K, respectively.

A driving motor drives and rotates the photoconductive drums 5Y, 5M, 5C, and 5K clockwise in FIG. 1. The charger 75 disposed opposite each of the photoconductive drums 5Y, 5M, 5C, and 5K uniformly charges the outer circumferential surface thereof in a charging process.

When the charged outer circumferential surface of each of the photoconductive drums 5Y, 5M, 5C, and 5K reaches an irradiation position where an exposure device 3 is disposed opposite each of the photoconductive drums 5Y, 5M, 5C, and 5K, laser beams L emitted from the exposure device 3 irradiate and scan the photoconductive drums 5Y, 5M, 5C, and 5K, respectively, forming electrostatic latent images according to yellow, magenta, cyan, and black image data in an exposure process.

When the scanned outer circumferential surface of each of the photoconductive drums 5Y, 5M, 5C, and 5K reaches a developing position where the developing device 76 is disposed opposite each of the photoconductive drums 5Y, 5M, 5C, and 5K, the developing device 76 develops the electrostatic latent image formed on the respective photoconductive drums 5Y, 5M, 5C, and 5K, thus forming yellow, magenta, cyan, and black toner images on the photoconductive drums 5Y, 5M, 5C, and 5K in a developing process.

When the yellow, magenta, cyan, and black toner images formed on the photoconductive drums 5Y, 5M, 5C, and 5K reach primary transfer nips formed between the photoconductive drums 5Y, 5M, 5C, and 5K and the intermediate transfer belt 78 by four primary transfer bias rollers 79Y, 79M, 79C, and 79K pressed against the four photoconductive drums 5Y, 5M, 5C, and 5K via the intermediate transfer belt 78, respectively, the yellow, magenta, cyan, and black toner images formed on the photoconductive drums 5Y, 5M, 5C, and 5K, respectively, are primarily transferred onto the intermediate transfer belt 78 in a primary transfer process. After the primary transfer process, residual toner failed to be transferred onto the intermediate transfer belt 78 remains on the photoconductive drums 5Y, 5M, 5C, and 5K slightly.

When the residual toner on the outer circumferential surface of each of the photoconductive drums 5Y, 5M, 5C, and 5K reaches a cleaning position where the cleaner 77 is disposed opposite each of the photoconductive drums 5Y, 5M, 5C, and 5K, a cleaning blade of the cleaner 77 mechanically collects the residual toner from each of the photoconductive drums 5Y, 5M, 5C, and 5K in a cleaning process.

Finally, when the cleaned outer circumferential surface of each of the photoconductive drums 5Y, 5M, 5C, and 5K reaches a discharging position where the discharger is disposed opposite each of the photoconductive drums 5Y, 5M, 5C, and 5K, the discharger eliminates residual potential from each of the photoconductive drums 5Y, 5M, 5C, and 5K. Thus, a series of image forming processes performed on the photoconductive drums 5Y, 5M, 5C, and 5K is finished.

The yellow, magenta, cyan, and black toner images formed on the photoconductive drums 5Y, 5M, 5C, and 5K in the developing process are primarily transferred onto an outer circumferential surface of the intermediate transfer belt 78 such that the yellow, magenta, cyan, and black toner images are superimposed on a same position on the intermediate transfer belt 78. Thus, a full color toner image is formed on the outer circumferential surface of the intermediate transfer belt 78.

For example, the intermediate transfer unit 85 includes the intermediate transfer belt 78, the four primary transfer bias rollers 79Y, 79M, 79C, and 79K, a secondary transfer backup roller 82, a cleaning backup roller 83, a tension roller 84, and an intermediate transfer belt cleaner 80. The intermediate transfer belt 78 is stretched taut across and supported by the three rollers, that is, the secondary transfer backup roller 82, the cleaning backup roller 83, and the tension roller 84. One of the three rollers, that is, the secondary transfer backup roller 82 drives and rotates the intermediate transfer belt 78 counterclockwise in FIG. 1 in a rotation direction D78.

The four primary transfer bias rollers 79Y, 79M, 79C, and 79K sandwich the intermediate transfer belt 78 together with the four photoconductive drums 5Y, 5M, 5C, and 5K, respectively, forming the four primary transfer nips between the intermediate transfer belt 78 and the photoconductive drums 5Y, 5M, 5C, and 5K. The primary transfer bias rollers 79Y, 79M, 79C, and 79K are applied with a primary transfer bias having a polarity opposite a polarity of electric charge of toner.

As the intermediate transfer belt 78 rotates in the rotation direction D78 and travels through the four primary transfer nips successively, the yellow, magenta, cyan, and black toner images formed on the four photoconductive drums 5Y, 5M, 5C, and 5K, respectively, are primarily transferred onto the intermediate transfer belt 78 such that the yellow, magenta, cyan, and black toner images are superimposed on the same position on the intermediate transfer belt 78.

Thereafter, the yellow, magenta, cyan, and black toner images superimposed on the intermediate transfer belt 78 reach a secondary transfer position where a secondary transfer roller 89 is disposed opposite the intermediate transfer belt 78. At the secondary transfer position, the secondary transfer backup roller 82 sandwiches the intermediate transfer belt 78 together with the secondary transfer roller 89, forming a secondary transfer nip between the secondary transfer roller 89 and the intermediate transfer belt 78. The yellow, magenta, cyan, and black toner images superimposed on the intermediate transfer belt 78 are secondarily transferred onto a recording medium P conveyed through the secondary transfer nip in a secondary transfer process. After the secondary transfer process, residual toner failed to be transferred on the recording medium P remains on the intermediate transfer belt 78.

Thereafter, the residual toner remaining on the outer circumferential surface of the intermediate transfer belt 78 reaches a cleaning position where the intermediate transfer belt 78 is disposed opposite the inter mediate transfer belt cleaner 80. When the residual toner on the intermediate transfer belt 78 reaches the cleaning position, the intermediate transfer belt cleaner 80 collects the residual toner from the intermediate transfer belt 78. Thus, a series of transfer processes performed on the intermediate transfer belt 78 is finished.

The recording medium P conveyed through the secondary transfer nip is conveyed from a paper tray 12 situated in a lower portion of the image forming apparatus 1 through a feed roller 97, a registration roller pair 98 (e.g., a timing roller pair), and the like. The paper tray 12 loads a plurality of recording media P (e.g., transfer sheets) layered. As the feed roller 97 rotates counterclockwise in FIG. 1, the feed roller 97 feeds an uppermost recording medium P to a roller nip formed between two rollers of the registration roller pair 98.

As the recording medium P contacts the roller nip of the registration roller pair 98, the registration roller pair 98 that interrupts its rotation temporarily halts the recording medium P. The registration roller pair 98 resumes its rotation to feed the recording medium P to the secondary transfer nip at a time when the color toner image formed on the intermediate transfer belt 78 reaches the secondary transfer nip. As the recording medium P is conveyed through the secondary transfer nip, the color toner image formed on the intermediate transfer belt 78 is secondarily transferred onto the recording medium P.

Thereafter, the recording medium P transferred with the color toner image at the secondary transfer nip is conveyed to a fixing device 20. The fixing device 20 includes a fixing belt 21 serving as a fixing rotator and a pressure roller 31 serving as a pressure rotator pressed against the fixing belt 21 to form a fixing nip therebetween. As the recording medium P bearing the color toner image is conveyed through the fixing nip, the fixing belt 21 and the pressure roller 31 fix the color toner image on the recording medium P under heat and pressure.

Thereafter, the recording medium P bearing the fixed toner image is conveyed through a roller nip formed by an output roller pair 99 and ejected by the output roller pair 99 onto an outside of the image forming apparatus 1. The recording medium P ejected by the output roller pair 99 onto the outside of the image forming apparatus 1 is stacked on an output tray 100 as a print. Thus, a series of image forming processes performed by the image forming apparatus 1 is completed.

Figure 2:
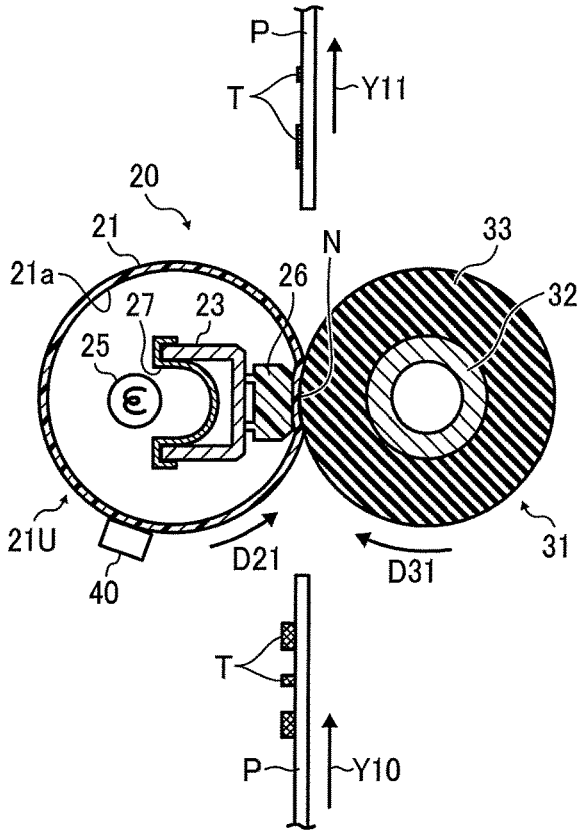
FIG. 2 is a schematic vertical cross-sectional view of a fixing device incorporated in the image forming apparatus depicted in FIG. 1.
Figure 3:
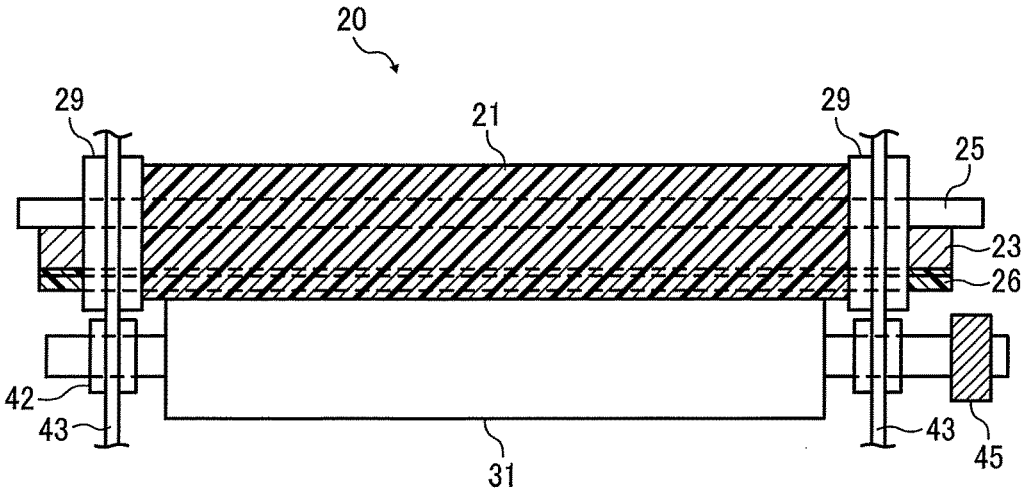
FIG. 3 is a side view of the fixing device depicted in FIG. 2.
Figure 4:
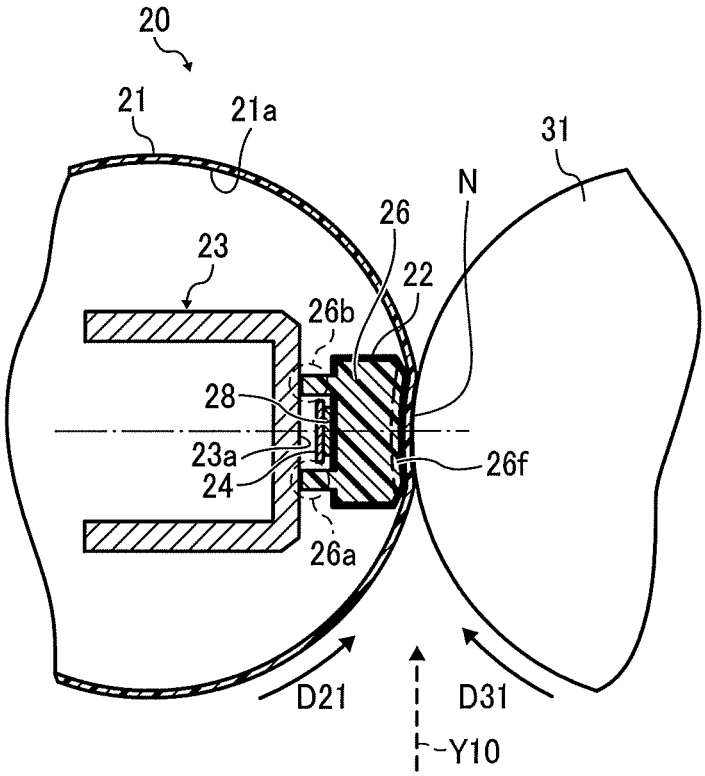
FIG. 4 is a partially enlarged cross-sectional view of the fixing device depicted in FIG. 2.

Referring to FIGS. 2 to 4, a description is provided of a construction and an operation of the fixing device 20 incorporated in the image forming apparatus 1.

FIG. 2 is a vertical cross-sectional view of the fixing device 20. FIG. 3 is a side view of the fixing device 20. FIG. 4 is a partially enlarged cross-sectional view of the fixing device 20.

As illustrated in FIGS. 2 to 4, the fixing device 20 (e.g., a fuser or a fusing unit) includes the fixing belt 21 (e.g., an endless belt) serving as a fixing rotator, a nip formation pad 26 serving as a stationary component, a reinforcement 23, a heater 25 serving as a heat source, the pressure roller 31 serving as a pressure rotator, a temperature sensor 40, a lubricant supplying sheet 22 serving as a lubricant supplier, a screw 24, a plate 28 serving as a stationary plate, and a reflector 27. The fixing belt 21 and the components disposed inside a loop formed by the fixing belt 21, that is, the lubricant supplying sheet 22, the nip formation pad 26, the reinforcement 23, the reflector 27, the heater 25, the screw 24, and the plate 28, may construct a belt unit 21U separably coupled with the pressure roller 31.

A detailed description is now given of a construction of the fixing belt 21.

The fixing belt 21 is a thin, flexible endless belt rotatable counterclockwise in FIG. 2 in a rotation direction D21. As illustrated in FIG. 4, the fixing belt 21 includes an inner circumferential surface 21*a* serving as a slide face that slides over the nip formation pad 26. The fixing belt 21 is constructed of a base layer serving as the inner circumferential surface 21*a*, an elastic layer coating the base layer, and a release layer coating the elastic layer, which define a total thickness of the fixing belt 21 not greater than 1 mm.

The base layer, having a layer thickness in a range of from about 30 micrometers to about 50 micrometers, is made of metal such as nickel and stainless steel or resin such as polyimide.

The elastic layer, having a layer thickness in a range of from 100 micrometers to 300 micrometers, is made of rubber such as silicone rubber, silicone rubber foam, and fluoro rubber. The elastic layer absorbs slight surface asperities of the fixing belt 21 at a fixing nip N formed between the fixing belt 21 and the pressure roller 31, facilitating even heat conduction from the fixing belt 21 to a toner image T on a recording medium P and thereby suppressing formation of an orange peel image on the recording medium P.

The release layer, having a layer thickness in a range of from 5 micrometers to 50 micrometers, is made of tetrafluoroethylene-perfluoroalkylvinylether copolymer (PFA), polytetrafluoroethylene (PTFE), polyimide (PI), polyether imide (PEI), polyether sulfide (PES), or the like. The release layer facilitates separation or peeling-off of toner of the toner image T on the recording medium P from the fixing belt 21.

A loop diameter of the fixing belt 21 is in a range of from 15 mm to 120 mm. According to this embodiment, the fixing belt 21 has a loop diameter of about 30 mm.

The nip formation pad 26, the heater 25, the reinforcement 23, the reflector 27, the lubricant supplying sheet 22, the screw 24, the plate 28 serving as the stationary plate, and the like are stationarily disposed inside the loop formed by the fixing belt 21 and disposed opposite the inner circumferential surface 21*a* of the fixing belt 21, thus constructing the belt unit 21U.

The nip formation pad 26 is stationarily disposed inside the loop formed by the fixing belt 21 such that the inner circumferential surface 21*a* of the fixing belt 21 slides over the nip formation pad 26. The nip formation pad 26 presses against the pressure roller 31 via the fixing belt 21 to form the fixing nip N between the fixing belt 21 and the pressure roller 31, through which the recording medium P is conveyed. As illustrated in FIG. 3, both lateral ends of the fixing belt 21 in an axial direction thereof are rotatably supported by a pair of flanges 29 serving as a holder secured to and supported by side plates 43 of the fixing device 20, respectively. The heater 25 disposed inside the loop formed by the fixing belt 21 heats the fixing belt 21 directly with radiation heat or light.

A detailed description is now given of a configuration of the heater 25.

The heater 25 is a halogen heater or a carbon heater. As illustrated in FIG. 3, both lateral ends of the heater 25 in a longitudinal direction thereof are mounted on or secured to the side plates 43 of the fixing device 20, respectively. As a power supply disposed inside the image forming apparatus 1 controls output of the heater 25, the heater 25 heats the fixing belt 21 with radiation heat or light mainly in an outboard circumferential span of the fixing belt 21 other than the fixing nip N depicted in FIG. 2. Heat is conducted from an outer circumferential surface of the fixing belt 21 heated by the heater 25 to the toner image T on the recording medium P. Output of the heater 25 is controlled based on the temperature of the outer circumferential surface of the fixing belt 21 detected by the temperature sensor 40. The temperature sensor 40 is a thermistor or the like disposed opposite the outer circumferential surface of the fixing belt 21. Thus, the fixing belt 21 is heated to a desired fixing temperature by the heater 25 controlled as described above.

According to this embodiment, the single heater 25 is disposed opposite the inner circumferential surface 21*a* of the fixing belt 21. Alternatively, a plurality of heaters may be disposed opposite the inner circumferential surface 21*a* of the fixing belt 21.

The heater 25 does not heat a part of the fixing belt 21 locally but does heat the fixing belt 21 in a substantial span of the fixing belt 21 in a circumferential direction of the fixing belt 21. Accordingly, even if the fixing belt 21 rotates at high speed, the heater 25 heats the fixing belt 21 sufficiently, suppressing fixing failure. That is, the fixing device 20 heats the fixing belt 21 efficiently with a relatively simple structure, shortening a warm-up time and a first print time taken to output the recording medium P bearing the fixed toner image T upon receipt of a print job through preparation for a print operation and the subsequent print operation and downsizing the fixing device 20. Since the heater 25 heats the fixing belt 21 directly, the heater 25 heats the fixing belt 21 with improved heating efficiency of heating the fixing belt 21, allowing the fixing device 20 to be downsized at reduced manufacturing costs.

Figure 5:
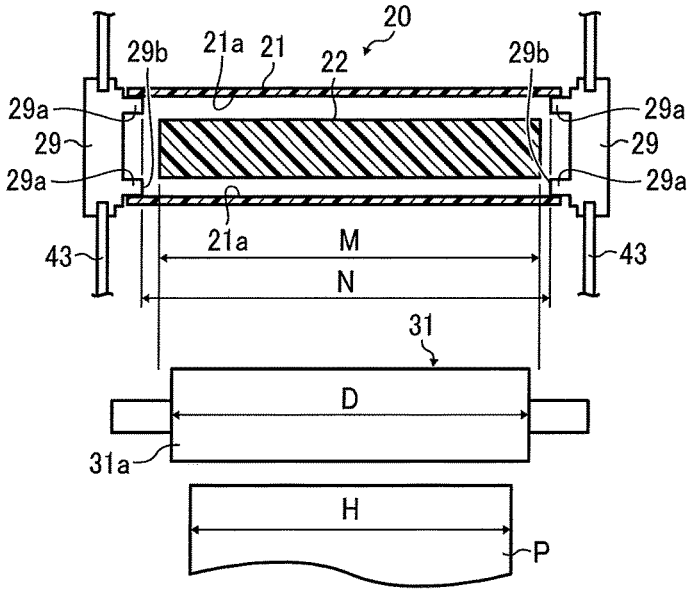
FIG. 5 is an exploded cross-sectional view of the fixing device depicted in FIG. 3.

Referring to FIG. 5, a detailed description is now given of a configuration of the flanges 29.

FIG. 5 is an exploded cross-sectional view of the fixing device 20. The two flanges 29 serving as a holder are made of heat resistant resin or the like. The flanges 29 are fitted in the side plates 43 disposed at both lateral ends of the fixing device 20 in a longitudinal direction thereof, respectively. The flange 29 includes a guide and a stopper. The guide supports the fixing belt 21 to be circular in cross-section. The stopper restricts motion or skew of the fixing belt 21 in the axial direction thereof.

Alternatively, a slipping member (e.g., a ring) may be disposed on the stopper of the flange 29 separately from the flange 29. The slipping member is made of a heat resistant material that reduces friction such as polyether ether ketone (PEEK), polyphenylene sulfide (PPS), polyamide imide (PAI), and PTFE to reduce abrasion of each lateral end of the fixing belt 21 in the axial direction thereof.

According to this embodiment, the inner circumferential surface 21*a* of the fixing belt 21 is contacted by the flanges 29 at both lateral ends of the fixing belt 21 in the axial direction thereof, respectively, and the lubricant supplying sheet 22 pressed against the fixing belt 21 by the nip formation pad 26. No component other than the flanges 29 and the lubricant supplying sheet 22, such as a belt guide to guide the fixing belt 21 as it rotates, contacts the inner circumferential surface 21*a* of the fixing belt 21.

In order to improve heating efficiency of heating the fixing belt 21 and downsize the fixing device 20 at reduced manufacturing costs, a heat pipe is removed from the fixing device 20 and the heater 25 heats the fixing belt 21 directly without the heat pipe interposed between the heater 25 and the fixing belt 21. For example, the flanges 29 support the inner circumferential surface 21*a* of the fixing belt 21.

A detailed description is now given of a configuration of the reinforcement 23.

As illustrated in FIG. 2, the reinforcement 23 is stationarily disposed opposite the inner circumferential surface 21*a* of the fixing belt 21. The reinforcement 23 reinforces the nip formation pad 26 that forms the fixing nip N, enhancing the mechanical strength of the nip formation pad 26. As illustrated in FIG. 3, the reinforcement 23 has a length in a longitudinal direction thereof parallel to the axial direction of the fixing belt 21 that is equivalent to a length of the nip formation pad 26 in a longitudinal direction thereof. Both lateral ends of the reinforcement 23 in the longitudinal direction thereof are supported by the flanges 29 serving as a holder, respectively. For example, the reinforcement 23 is sandwiched and positioned between the flange 29 and the nip formation pad 26.

The reinforcement 23 presses against the pressure roller 31 via the nip formation pad 26 and the fixing belt 21, suppressing substantial deformation of the nip formation pad 26 at the fixing nip N by pressure from the pressure roller 31. According to this embodiment, as illustrated in FIG. 2, the reinforcement 23 is a plate that is substantially U-shaped in cross-section to have a recess that is disposed opposite the heater 25. The reinforcement 23 is made of metal having an increased mechanical strength, such as stainless steel and iron, to attain the advantages described above.

According to this embodiment, the reflector 27 (e.g., a reflection plate) is mounted on or secured to an opposed face of the reinforcement 23, which is disposed opposite the heater 25. Accordingly, the reflector 27 reflects heat radiated from the heater 25 toward the reinforcement 23, that is, heat that may heat the reinforcement 23, to the fixing belt 21 so that the heat is used to heat the fixing belt 21, improving heating efficiency in heating the fixing belt 21. The reflector 27 is made of aluminum, stainless steel, or the like.

Alternatively, the opposed face of the reinforcement 23, which is disposed opposite the heater 25, may be partially or entirely treated with mirror polishing or coated with an insulator. In this case also, the reinforcement 23 attains the advantages described above.

A detailed description is now given of a construction of the pressure roller 31.

As illustrated in FIG. 2, the pressure roller 31 serves as a pressure rotator that contacts the outer circumferential surface of the fixing belt 21 at the fixing nip N. The pressure roller 31, having a diameter of about 30 mm, is constructed of a hollow core bar 32 and an elastic layer 33 coating the core bar 32. The elastic layer 33 is made of silicone rubber foam, silicone rubber, fluoro rubber, or the like. Optionally, a thin release layer made of PFA, PTFE, or the like may coat an outer circumferential surface of the elastic layer 33. The pressure roller 31 is pressed against the fixing belt 21 to form the desired fixing nip N between the pressure roller 31 and the fixing belt 21. As illustrated in FIG. 3, the pressure roller 31 mounts a gear 45 that engages a driving gear of a driver so that the pressure roller 31 is driven and rotated clockwise in FIG. 2 in a rotation direction D31. The driver may also be coupled to the flange 29 supporting the fixing belt 21 to drive and rotate the fixing belt 21. Both lateral ends of the pressure roller 31 in an axial direction thereof are rotatably supported by the side plates 43 of the fixing device 20 through bearings 42, respectively. Optionally, a heater such as a halogen heater may be situated inside the pressure roller 31.

If the elastic layer 33 of the pressure roller 31 is made of sponge such as silicone rubber foam, the elastic layer 33 decreases pressure exerted to the fixing nip N, reducing a load imposed on the nip formation pad 26. Additionally, the elastic layer 33 made of sponge enhances thermal insulation of the pressure roller 31, reducing heat conduction from the fixing belt 21 to the pressure roller 31 and thereby improving heating efficiency in heating the fixing belt 21.

As illustrated in FIG. 2, the loop diameter of the fixing belt 21 is equivalent to the diameter of the pressure roller 31. Alternatively, the loop diameter of the fixing belt 21 may be smaller than the diameter of the pressure roller 31. In this case, a curvature of the fixing belt 21 is greater than a curvature of the pressure roller 31 at the fixing nip N, facilitating separation of the recording medium P from the fixing belt 21 as it is ejected from the fixing nip N.

A detailed description is now given of a construction of the nip formation pad 26.

As illustrated in FIG. 4, the inner circumferential surface 21*a* of the fixing belt 21 slides over the nip formation pad 26 via the lubricant supplying sheet 22. The nip formation pad 26 includes an opposed face (e.g., a slide face) that is disposed opposite the pressure roller 31 and curved in cross-section to produce a recess that curves the fixing belt 21 along a curve of the pressure roller 31. Accordingly, the recording medium P is curved along the curve of the pressure roller 31 as the recording medium P is ejected from the fixing nip N, suppressing a failure in which the recording medium P ejected from the fixing nip N adheres to the fixing belt 21 and thereby does not separate from the fixing belt 21.

According to this embodiment, the nip formation pad 26 is recessed relative to the pressure roller 31 at the fixing nip N. Alternatively, the nip formation pad 26 may be planar in cross-section at the fixing nip N. For example, the opposed face (e.g., the slide face) of the nip formation pad 26, which is disposed opposite the pressure roller 31, may be planar in cross-section. In this case, the opposed face of the nip formation pad 26 at the fixing nip N is substantially parallel to an imaged face of the recording medium P, which bears the toner image T, facilitating adhesion of the fixing belt 21 to the recording medium P and enhancing fixing property of heating the fixing belt 21 quickly. Additionally, a curvature of the fixing belt 21 at an exit of the fixing nip N is greater than that of the pressure roller 31, facilitating separation of the recording medium P ejected from the fixing nip N from the fixing belt 21.

The nip formation pad 26 is made of resin or metal. Preferably, the nip formation pad 26 is made of resin that has a rigidity great enough to prevent substantial bending even if the nip formation pad 26 receives pressure from the pressure roller 31 and is febrile and insulative, such as liquid crystal polymer (LCP), PAI, PES, PPS, polyether nitrile (PEN), and PEEK. According to this embodiment, the nip formation pad 26 is made of LCP.

The nip formation pad 26 includes projections 26*a* and 26*b* that project toward and contact an opposed face 23*a* of the reinforcement 23. The projections 26*a* and 26*b* are arranged in a recording medium conveyance direction Y10 in which the recording medium P is conveyed or the rotation direction D21 of the fixing belt 21 such that the projections 26*a* and 26*b* define a plurality of rows. For example, as one of the plurality of rows, the projection 26*a* is disposed upstream from the projection 26*b* in the recording medium conveyance direction Y10. The projection 26*a* projects toward and contacts the opposed face 23*a* of the reinforcement 23. As another one of the plurality of rows, the projection 26*b* is disposed downstream from the projection 26*a* in the recording medium conveyance direction Y10. The projection 26*b* projects toward and contacts the opposed face 23*a* of the reinforcement 23. That is, the nip formation pad 26 includes the projections 26*a* and 26*b* defining two rows disposed opposite the opposed face 23*a* of the reinforcement 23. The projection 26*b* is separated from the projection 26*a* in the recording medium conveyance direction Y10. The projections 26*a* and 26*b*, defining the two rows, surface-contact the opposed face 23*a* of the reinforcement 23.

The lubricant supplying sheet 22 covers the nip formation pad 26. The lubricant supplying sheet 22 is made of a low-friction material, such as PTFE, that decreases a resistance of the nip formation pad 26 against the fixing belt 21 sliding over the nip formation pad 26. For example, the lubricant supplying sheet 22 is sandwiched between the nip formation pad 26 and the fixing belt 21 at the fixing nip N throughout the substantially entire width of the fixing belt 21 in the axial direction thereof. Accordingly, the lubricant supplying sheet 22 substantially surrounds or circumferentially covers the nip formation pad 26 in cross-section in FIG. 4. According to this embodiment, the lubricant supplying sheet 22 is made of a fiber impregnated with a lubricant such as silicone oil, for example, cloth made of fluoroplastic such as PTFE. Accordingly, the lubricant supplying sheet 22 covering a belt side face 26*f* of the nip formation pad 26, which is disposed opposite the inner circumferential surface 21*a* of the fixing belt 21, bears the lubricant. Consequently, the lubricant supplying sheet 22 reduces abrasion of the fixing belt 21 and the nip formation pad 26 that may be caused by the fixing belt 21 sliding over the nip formation pad 26.

As illustrated in FIG. 4, the lubricant supplying sheet 22 covers the nip formation pad 26. The nip formation pad 26 and the plate 28 sandwich an overlap portion of the lubricant supplying sheet 22 where one end of the lubricant supplying sheet 22 overlaps another end of the lubricant supplying sheet 22 on a reinforcement side face of the nip formation pad 26 disposed opposite the reinforcement 23. The screw 24 fastens the plate 28 to the nip formation pad 26.

A detailed description of a configuration and motion of the lubricant supplying sheet 22 is deferred.

A description is provided of a regular fixing operation to fix the toner image T on the recording medium P, which is performed by the fixing device 20 having the construction described above.

As the image forming apparatus 1 depicted in FIG. 1 is powered on, the heater 25 depicted in FIG. 2 is supplied with power and the driver starts driving and rotating the pressure roller 31 clockwise in FIG. 4 in the rotation direction D31. Accordingly, the pressure roller 31 drives and rotates the fixing belt 21 in the rotation direction D21 by friction therebetween generated at the fixing nip N.

As illustrated in FIG. 1, the feed roller 97 picks up and feeds a recording medium P from the paper tray 12 to the registration roller pair 98 that conveys the recording medium P to the secondary transfer nip where the secondary transfer roller 89 secondarily transfers an unfixed color toner image, that is, a toner image T, from the intermediate transfer belt 78 onto the recording medium P. As illustrated in FIG. 2, the recording medium P bearing the unfixed toner image T is conveyed in the recording medium conveyance direction Y10 while the recording medium P is guided by a guide plate and enters the fixing nip N formed between the fixing belt 21 and the pressure roller 31 pressed against the fixing belt 21.

The toner image T is fixed on a surface of the recording medium P under heat from the fixing belt 21 heated by the heater 25 and pressure exerted from the fixing belt 21 and the pressure roller 31 pressed against the nip formation pad 26 supported by the reinforcement 23 via the fixing belt 21. Thereafter, the recording medium P is ejected from the fixing nip N and conveyed in a recording medium conveyance direction Y11.

A description is provided of a construction of a comparative fixing device.

The comparative fixing device includes a fixing belt supported by a holder (e.g., a flange) at each lateral end of the fixing belt in an axial direction thereof.

The comparative fixing device further includes a pressure roller, a nip formation pad, and a heater. The nip formation pad is disposed inside a loop formed by the fixing belt and presses against the pressure roller via the fixing belt to form a fixing nip between the pressure roller and the fixing belt. The heater is disposed opposite an inner circumferential surface of the fixing belt. A sheet impregnated with a lubricant covers the nip formation pad to decrease a frictional resistance of the nip formation pad against the fixing belt sliding over the nip formation pad.

As a recording medium bearing a toner image is conveyed through the fixing nip, the fixing belt heated by a heater directly and the pressure roller fix the toner image on the recording medium under heat and pressure.

The sheet made of a fiber has weave texture directed in a predetermined direction to move the lubricant impregnated in the sheet from one end to another end in a width direction of the sheet.

The sheet impregnated with the lubricant is sandwiched between the fixing belt and the nip formation pad, decreasing the frictional resistance of the nip formation pad against the fixing belt sliding over the nip formation pad.

However, the lubricant impregnated in the sheet may leak from a lateral end of the sheet in the width direction thereof through a gap between the fixing belt and the holder. If an amount of the leaked lubricant increases, the sheet may degrade in decreasing the frictional resistance of the nip formation pad against the fixing belt at the fixing nip, thus accelerating abrasion and degradation of the fixing belt and the nip formation pad.

A description is provided of a configuration and an operation of the fixing device 20 in detail.

As described above, the lubricant supplying sheet 22 is interposed between the nip formation pad 26 and the fixing belt 21 at the fixing nip N. The lubricant supplying sheet 22, which is made of a low friction material and impregnated with the lubricant, covers the nip formation pad 26.

The lubricant supplying sheet 22 has a thickness in a range of from 150 micrometers to 500 micrometers. The lubricant supplying sheet 22 is made of a fiber that contains fluoroplastic such as PTFE and is impregnated with the lubricant being made of silicone oil, fluorine grease, or the like and having a viscosity in a range of from 50 cs to 1,000 cs.

The lubricant supplying sheet 22 made of the fiber facilitates permeation of the lubricant into a texture of the fiber, thus retaining the lubricant precisely. Additionally, since the lubricant supplying sheet 22 is made of the fiber containing fluoroplastic that reduces friction, even if the lubricant held by the lubricant supplying sheet 22 dries up, the lubricant supplying sheet 22 decreases the resistance of the nip formation pad 26 against the fixing belt 21 sliding over the nip formation pad 26 at the fixing nip N to a certain degree.

As illustrated in FIG. 5, the lubricant supplying sheet 22 has a sheet span M in a width direction thereof parallel to the axial direction of the fixing belt 21. A holder interval N is provided between the flange 29 serving as a holder disposed at one lateral end, that is, a left end in FIG. 5, of the fixing belt 21 and the flange 29 serving as a holder disposed at another lateral end, that is, a right end in FIG. 5, of the fixing belt 21 in the axial direction thereof. The sheet span M of the lubricant supplying sheet 22 is within the holder interval N in the axial direction of the fixing belt 21.

The holder interval N between the two flanges 29 in the axial direction of the fixing belt 21 is defined between an inboard face 29*b* of an abutment portion 29*a* of the left flange 29 and another inboard face 29*b* of another abutment portion 29*a* of the right flange 29. The abutment portion 29*a* contacts the inner circumferential surface 21*a* of the fixing belt 21. In other words, the holder interval N between the two flanges 29 in the axial direction of the fixing belt 21 is a center span of the fixing belt 21 where the fixing belt 21 does not contact the two flanges 29.

According to this embodiment, the sheet span M of the lubricant supplying sheet 22 in the axial direction of the fixing belt 21 is smaller than the holder interval N between the two flanges 29. The lubricant supplying sheet 22 is placed within the holder interval N between the two flanges 29.

Accordingly, even if the lubricant impregnated in the lubricant supplying sheet 22 moves toward one lateral end or another lateral end of the fixing belt 21 in the axial direction thereof, the lubricant does not reach the abutment portion 29*a* of the flange 29, that contacts the fixing belt 21. Consequently, the lubricant supplying sheet 22 reduces leakage of the lubricant impregnated in the lubricant supplying sheet 22 from a lateral end of the lubricant supplying sheet 22 in the axial direction thereof through a gap between the fixing belt 21 and the flange 29. As a result, the lubricant supplying sheet 22 reduces abrasion and degradation of the fixing belt 21 and the nip formation pad 26, which may occur or accelerate when the amount of the lubricant leaking from the lateral end of the lubricant supplying sheet 22 in the longitudinal direction thereof increases and the lubricant supplying sheet 22 does not decease the frictional resistance of the nip formation pad 26 against the fixing belt 21 sliding over the nip formation pad 26 at the fixing nip N.

As illustrated in FIG. 5, a maximum conveyance span H in the axial direction of the fixing belt 21 defines a span where a recording medium P of a maximum size available in the image forming apparatus 1 is conveyed over the fixing belt 21. The sheet span M of the lubricant supplying sheet 22 encompasses the maximum conveyance span H in the axial direction of the fixing belt 21. In other words, the maximum conveyance span H is within the sheet span M. For example, the sheet span M of the lubricant supplying sheet 22 in the axial direction of the fixing belt 21 is greater than the maximum conveyance span H. The maximum conveyance span H is placed within the sheet span M of the lubricant supplying sheet 22 in the axial direction of the fixing belt 21.

The maximum conveyance span H defines a span in the axial direction of the fixing belt 21 where the recording medium P of the maximum size available in the fixing device 20 and the image forming apparatus 1 is conveyed.

Accordingly, even if a recording medium P of any size is conveyed through the fixing nip N, the lubricant decreases the resistance of the nip formation pad 26 against the fixing belt 21 sliding over the nip formation pad 26, thus allowing the nip formation pad 26 to press against the pressure roller 31 precisely at the fixing nip N with pressure being uniform throughout the entire width of the fixing belt 21 in the axial direction thereof. Consequently, the lubricant supplying sheet 22 reduces creasing of the recording medium P ejected from the fixing nip N.

As illustrated in FIG. 5, the pressure roller 31 includes a roller portion 31*a* having a roller span D in the axial direction of the pressure roller 31. The sheet span M of the lubricant supplying sheet 22 encompasses the roller span D of the pressure roller 31 in the axial direction of the fixing belt 21. For example, the sheet span M of the lubricant supplying sheet 22 in the axial direction of the fixing belt 21 is greater than the roller span D of the pressure roller 31 in the axial direction thereof. In other words, the roller span D of the pressure roller 31 is within the sheet span M of the lubricant supplying sheet 22 in the axial direction of the fixing belt 21.

Accordingly, the lubricant decreases the resistance of the nip formation pad 26 against the fixing belt 21 sliding over the nip foliation pad 26, thus allowing the nip formation pad 26 to press against the pressure roller 31 precisely at the fixing nip N with pressure being uniform throughout the entire width of the fixing belt 21 in the axial direction thereof. Consequently, the lubricant supplying sheet 22 reduces creasing of the recording medium P ejected from the fixing nip N.

A high-viscosity lubricant such as grease, which has a viscosity greater than a viscosity of the lubricant impregnated in the lubricant supplying sheet 22, is interposed between the fixing belt 21 and the abutment portion 29*a* of the flange 29. For example, in a manufacturing process of the fixing device 20, the high-viscosity lubricant is applied to the abutment portion 29*a* of the flange 29, which contacts the fixing belt 21.

Accordingly, even if the lubricant impregnated in the lubricant supplying sheet 22 moves toward one lateral end or another lateral end of the fixing belt 21 in the axial direction thereof and reaches the abutment portion 29*a* of the flange 29 where the flange 29 contacts the fixing belt 21, the high-viscosity lubricant interposed between the fixing belt 21 and the flange 29 serves as a barrier that prohibits the lubricant impregnated in the lubricant supplying sheet 22 from moving farther toward one lateral end or another lateral end of the fixing belt 21 in the axial direction thereof. Consequently, the lubricant supplying sheet 22 reduces leakage of the lubricant impregnated in the lubricant supplying sheet 22 from the lateral end of the lubricant supplying sheet 22 in the longitudinal direction thereof through the gap between the fixing belt 21 and the flange 29.

Figure 6A:
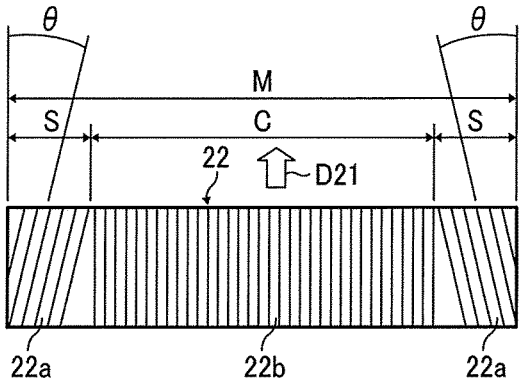
FIG. 6A is a schematic diagram of a lubricant supplying sheet incorporated in the fixing device depicted in FIG. 5, illustrating one example of a weave texture thereof.

FIG. 6A is a schematic diagram of the lubricant supplying sheet 22, illustrating one example of a weave texture thereof. As illustrated in FIG. 6A, the lubricant supplying sheet 22 includes two inclined weave texture portions 22*a*, that is, a first portion and a second portion, disposed at both lateral ends of the lubricant supplying sheet 22 in a longitudinal direction thereof parallel to the axial direction of the fixing belt 21, respectively. The fixing belt 21 slides over the inclined weave texture portions 22*a* of the lubricant supplying sheet 22. Each of the inclined weave texture portions 22*a* is made of a fiber having a weave texture extending substantially along the rotation direction D21 of the fixing belt 21 and inclining inboard from each lateral end toward a center of the lubricant supplying sheet 22 in the longitudinal direction thereof.

For example, as illustrated in FIG. 6A, the weave texture of each of the inclined weave texture portions 22*a* of the lubricant supplying sheet 22 is inclined relative to the rotation direction D21 of the fixing belt 21 at a predetermined inclination angle θ. Each of the inclined weave texture portions 22*a* has a span S in the longitudinal direction of the lubricant supplying sheet 22. The lubricant supplying sheet 22 includes a parallel weave texture portion 22*b* other than the inclined weave texture portions 22*a* in the longitudinal direction of the lubricant supplying sheet 22. The parallel weave texture portion 22*b* has a span C in the longitudinal direction of the lubricant supplying sheet 22 where a weave texture extends parallel to the rotation direction D21 of the fixing belt 21.

When a fiber is woven into the lubricant supplying sheet 22, a projection and a recess are produced on a surface of the lubricant supplying sheet 22 according to a method of weaving (e.g., a weaving direction). The recess (e.g., a groove) is a channel through which the lubricant moves. The weaving direction of the lubricant supplying sheet 22 is adjusted flexibly by the method of weaving. For example, the method of weaving (e.g., the weaving direction) for the inclined weave texture portions 22*a* is different from the method of weaving (e.g., the weaving direction) for the parallel weave texture portion 22*b* to manufacture the lubricant supplying sheet 22 that has the weave texture illustrated in FIG. 6A.

Alternatively, other than the method of weaving described above, the weave texture extending in the rotation direction D21 of the fixing belt 21 is produced throughout the entire span in the longitudinal direction of the lubricant supplying sheet 22. A load is imposed on the lubricant supplying sheet 22 to pull an upstream portion of each inclined weave texture portion 22*a* of the lubricant supplying sheet 22 in the rotation direction D21 of the fixing belt 21. Thus, the lubricant supplying sheet 22 is deformed to have the weave texture illustrated in FIG. 6A.

At least the inclined weave texture portions 22*a* of the lubricant supplying sheet 22 have the weave texture extending substantially in the rotation direction D21 of the fixing belt 21 and inclining inboard from each lateral end toward the center of the lubricant supplying sheet 22 in the longitudinal direction thereof. Accordingly, each of the inclined weave texture portions 22*a* of the lubricant supplying sheet 22 suppresses motion of the lubricant impregnated in the lubricant supplying sheet 22 toward the lateral end of the lubricant supplying sheet 22 in the longitudinal direction thereof. For example, in each of the inclined weave texture portions 22*a* of the lubricant supplying sheet 22, as the fixing belt 21 rotates in the rotation direction D21, the lubricant impregnated in the lubricant supplying sheet 22 moves from the inclined weave texture portion 22*a* toward the parallel weave texture portion 22*b* along the weave texture inclined relative to the rotation direction D21 of the fixing belt 21. Accordingly, the lubricant supplying sheet 22 reduces leakage of the lubricant impregnated in the lubricant supplying sheet 22 from the lateral end of the lubricant supplying sheet 22 in the longitudinal direction thereof through the gap between the fixing belt 21 and the flange 29.

For example, a combined span of the spans S of the inclined weave texture portions 22*a* of the lubricant supplying sheet 22 in the longitudinal direction thereof occupies 5 percent or more of the entire sheet span M of the lubricant supplying sheet 22 in the longitudinal direction thereof as defined by a formula (1) below.

$$2\times S/M\geq 0.05 \quad (1)$$

Accordingly, the lubricant supplying sheet 22 reduces leakage of the lubricant impregnated in the lubricant supplying sheet 22 from the lateral end of the lubricant supplying sheet 22 in the longitudinal direction thereof through the gap between the fixing belt 21 and the flange 29.

According to this embodiment, the span S of one inclined weave texture portion 22*a* is equivalent to the span S of another inclined weave texture portion 22*a*. Alternatively, the span S of one inclined weave texture portion 22*a* may be different from the span S of another inclined weave texture portion 22*a* according to flow of the lubricant in the longitudinal direction of the lubricant supplying sheet 22.

Figure 6B:
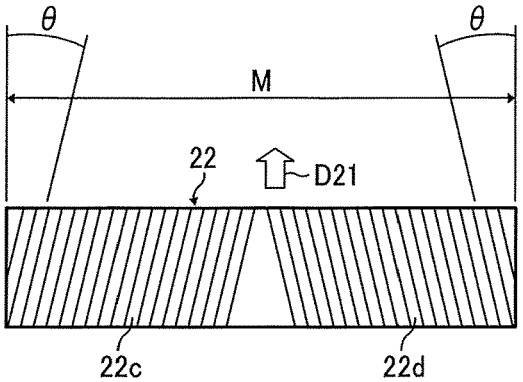
FIG. 6B is a schematic diagram of the lubricant supplying sheet incorporated in the fixing device depicted in FIG. 5, illustrating another example of a weave texture thereof.

FIG. 6B is a schematic diagram of the lubricant supplying sheet 22, illustrating another example of a weave texture thereof. As illustrated in FIG. 6B, the entire sheet span M of the lubricant supplying sheet 22 has the weave texture extending substantially in the rotation direction D21 of the fixing belt 21 and inclining inboard from each lateral end toward the center of the lubricant supplying sheet 22 in the longitudinal direction thereof.

For example, the lubricant supplying sheet 22 includes an inclined weave texture portion 22*c*, that is, a first portion or a left portion in FIG. 6B, and an inclined weave texture portion 22*d*, that is, a second portion or a right portion in FIG. 6B. The inclined weave texture portion 22*d* is adjacent to the inclined weave texture portion 22*c* in the longitudinal direction of the lubricant supplying sheet 22. The inclined weave texture portion 22*c* has a weave texture extending substantially in the rotation direction D21 of the fixing belt 21 and inclining rightward, that is, inboard from a left lateral end toward the center of the lubricant supplying sheet 22 in the longitudinal direction thereof. The inclined weave texture portion 22*d* has a weave texture extending substantially in the rotation direction D21 of the fixing belt 21 and inclining leftward, that is, inboard from a right lateral end toward the center of the lubricant supplying sheet 22 in the longitudinal direction thereof. In this configuration also, the lubricant supplying sheet 22 attains advantages equivalent to the advantages described above.

For example, the inclination angle θ of each of the inclined weave texture portions 22*a* where the weave texture is inclined relative to the rotation direction D21 of the fixing belt 21 as described above is in a range of from 1 degree to 45 degrees as defined by a formula (2) below.

$$1\leq\theta\leq 45 \quad (2)$$

If the inclination angle θ is below 1 degree, the lubricant may not move from the lateral end to the center of the lubricant supplying sheet 22 in the longitudinal direction thereof sufficiently. Conversely, if the inclination angle θ exceeds 45 degrees, the lubricant may move from the lateral end to the center of the lubricant supplying sheet 22 in the longitudinal direction thereof excessively, resulting in shortage of the lubricant at the lateral end of the lubricant supplying sheet 22.

To address this circumstance, according to this embodiment, the inclination angle θ of the weave texture is optimized within the above-described range. Accordingly, the lubricant supplying sheet 22 reduces leakage of the lubricant from the lateral end of the lubricant supplying sheet 22 in the longitudinal direction thereof without shortage of the lubricant at the lateral end of the lubricant supplying sheet 22 in the longitudinal direction thereof.

As described above with reference to FIGS. 3 and 4, the fixing device 20 includes the fixing belt 21, the pressure roller 31, the nip formation pad 26, the pair of flanges 29, and the lubricant supplying sheet 22. The nip formation pad 26 presses against the pressure roller 31 serving as a pressure rotator via the fixing belt 21 to form the fixing nip N. The pair of flanges 29 serving as a first holder and a second holder holds both lateral ends of the fixing belt 21 in the axial direction thereof, respectively. The lubricant supplying sheet 22 impregnated with the lubricant is interposed between the nip formation pad 26 and the fixing belt 21 at the fixing nip N. As illustrated in FIG. 5, the lubricant supplying sheet 22 has the sheet span M in the longitudinal direction thereof. The holder interval N is provided between the flange 29 disposed at one lateral end of the fixing belt 21 and the flange 29 disposed at another lateral end of the fixing belt 21 in the axial direction thereof. The sheet span M of the lubricant supplying sheet 22 is within the holder interval N in the axial direction of the fixing belt 21.

Accordingly, the lubricant supplying sheet 22 sandwiched between the fixing belt 21 and the nip formation pad 26 reduces leakage of the lubricant impregnated in the lubricant supplying sheet 22 from the lateral end of the lubricant supplying sheet 22 in the longitudinal direction thereof through the gap between the fixing belt 21 and the flange 29.

According to this embodiment, the heater 25 serves a heater or a heat source that heats the fixing belt 21. Alternatively, an exciting coil employing an electromagnetic induction heating method or a resistive heat generator may be used as a heater for heating the fixing belt 21, for example.

As illustrated in FIG. 4, the fixing device 20 includes the reinforcement 23 that is substantially U-shaped and the nip formation pad 26 including the projections 26*a* and 26*b* so that the heater 25 is situated at a position in proximity to a center of the loop formed by the fixing belt 21 as illustrated in FIG. 2. Alternatively, the reinforcement 23 and the nip formation pad 26 may have other configurations and the heater 25 may be situated at other positions. Thus, the embodiments described above are also applicable to fixing devices having other constructions. In those cases also, the fixing devices attain advantages equivalent to the advantages described above.

According to the embodiments described above, a state in which the nip formation pad 26 and the reinforcement 23 are secured defines a state in which the nip formation pad 26 and the reinforcement 23 are held such that the nip formation pad 26 and the reinforcement 23 are not driven and rotated. Accordingly, even if a biasing member such as a spring biases the nip formation pad 26 against the fixing belt 21 at the fixing nip N, the nip formation pad 26 is secured as long as the nip formation pad 26 is held such that the nip formation pad 26 is not rotatable.

According to the embodiments described above, the width direction defines a direction being perpendicular to the recording medium conveyance direction Y10 and parallel to the axial direction of the fixing belt 21 and the pressure roller 31.

A description is provided of advantages of the fixing device 20.

As illustrated in FIGS. 3 and 4, the fixing device 20 includes a fixing belt (e.g., the fixing belt 21), a pressure rotator (e.g., the pressure roller 31), a nip formation pad (e.g., the nip formation pad 26), a first holder (e.g., the flange 29), a second holder (e.g., the flange 29), and a lubricant supplying sheet (e.g., the lubricant supplying sheet 22).

The fixing belt is rotatable in a rotation direction (e.g., the rotation direction D21). The nip formation pad is disposed opposite an inner circumferential surface of the fixing belt. The pressure rotator presses against the nip formation pad via the fixing belt to form a fixing nip (e.g., the fixing nip N) between the pressure rotator and the fixing belt, through which a recording medium (e.g., the recording medium P) is conveyed. The first holder holds a first lateral end of the fixing belt in an axial direction thereof. The second holder holds a second lateral end of the fixing belt in the axial direction thereof. The lubricant supplying sheet is impregnated with a lubricant and is sandwiched between the nip formation pad and the fixing belt at the fixing nip. As illustrated in FIG. 5, the lubricant supplying sheet has a sheet span (e.g., the sheet span M) in the axial direction of the fixing belt. The first holder and the second holder define a holder interval (e.g., the holder interval N) provided therebetween in the axial direction of the fixing belt. The holder interval encompasses the sheet span.

Accordingly, the lubricant supplying sheet sandwiched between the fixing belt and the nip formation pad reduces leakage of the lubricant impregnated in the lubricant supplying sheet from a lateral end of the lubricant supplying sheet in the axial direction of the fixing belt through a gap between the fixing belt and each of the first holder and the second holder.

According to the embodiments described above, the fixing belt 21 serves as a fixing belt. Alternatively, a fixing film or the like may be used as a fixing belt. Further, the pressure roller 31 serves as a pressure rotator. Alternatively, a pressure belt or the like may be used as a pressure rotator.

The above-described embodiments are illustrative and do not limit the present disclosure. Thus, numerous additional modifications and variations are possible in light of the above teachings. For example, elements and features of different illustrative embodiments may be combined with each other and substituted for each other within the scope of the present invention.

Any one of the above-described operations may be performed in various other ways, for example, in an order different from the one described above.

What is claimed is:

1. A fixing device comprising:

a fixing belt rotatable in a rotation direction;

a nip formation pad disposed opposite an inner circumferential surface of the fixing belt;

a pressure rotator to press against the nip formation pad via the fixing belt to form a fixing nip between the pressure rotator and the fixing belt, the fixing nip through which a recording medium is conveyed;

a first holder holding a first lateral end of the fixing belt in an axial direction of the fixing belt;

a second holder holding a second lateral end of the fixing belt in the axial direction of the fixing belt, the second holder, together with the first holder, defining a holder interval provided between the first holder and the second holder in the axial direction of the fixing belt; and a lubricant supplying sheet sandwiched between the nip formation pad and the fixing belt at the fixing nip, the lubricant supplying sheet having a sheet span in the axial direction of the fixing belt, the sheet span being within the holder interval, wherein a maximum conveyance span of the fixing device for the recording medium of a maximum size usable with the fixing device is within the sheet span.

2. The fixing device according to claim 1, wherein a high-viscosity lubricant having a viscosity greater than a viscosity of a lubricant impregnated in the lubricant supplying sheet is interposed between the fixing belt and each of the first holder and the second holder.

3. The fixing device according to claim 1, wherein the lubricant supplying sheet is made of a fiber.

4. The fixing device according to claim 3, wherein the lubricant supplying sheet includes an inclined weave texture portion having a weave texture inclined relative to the rotation direction of the fixing belt from a lateral edge toward a center of the lubricant supplying sheet in the axial direction of the fixing belt.

5. The fixing device according to claim 4, wherein the weave texture of the inclined weave texture portion is inclined at an inclination angle in a range of from 1 degree to 45 degrees.

6. The fixing device according to claim 4, wherein the inclined weave texture portion includes:

a first portion; and a second portion being adjacent to the first portion in the axial direction of the fixing belt.

7. The fixing device according to claim 4, wherein the inclined weave texture portion includes:

a first portion disposed at one lateral end of the lubricant supplying sheet in the axial direction of the fixing belt; and a second portion disposed at another lateral end of the lubricant supplying sheet in the axial direction of the fixing belt.

8. The fixing device according to claim 7, wherein the first portion has a first span in the axial direction of the fixing belt and the second portion has a second span in the axial direction of the fixing belt, and wherein a combined span of the first span and the second span occupies 5 percent or more of the sheet span of the lubricant supplying sheet.

9. The fixing device according to claim 7, wherein the lubricant supplying sheet further includes a parallel weave texture portion interposed between the first portion and the second portion in the axial direction of the fixing belt, the parallel weave texture portion having a weave texture parallel to the rotation direction of the fixing belt.

10. The fixing device according to claim 1, wherein the pressure rotator includes a roller portion having a roller span in the axial direction of the fixing belt, the roller span being within the sheet span of the lubricant supplying sheet.

11. The fixing device according to claim 1, wherein the lubricant supplying sheet is impregnated with a lubricant.

12. The fixing device according to claim 1, wherein the nip formation pad includes a plurality of projections disposed in a plurality of rows disposed along the rotation direction of the fixing belt.

13. The fixing device according to claim 12, further comprising:

a reinforcement inside a loop formed by the fixing belt to enhance a mechanical strength of the nip formation pad, wherein the projections contact the reinforcement.

14. The fixing device according to claim 13, wherein the projections surface-contact the reinforcement.

15. The fixing device according to claim 1, further comprising:

a reinforcement inside a loop formed by the fixing belt to enhance mechanical strength of the nip formation pad.

16. An image forming apparatus comprising:

an image forming device to form a toner image; and a fixing device to fix the toner image on a recording medium, the fixing device including:

a fixing belt rotatable in a rotation direction;

a nip formation pad disposed opposite an inner circumferential surface of the fixing belt;

a pressure rotator to press against the nip formation pad via the fixing belt to form a fixing nip between the pressure rotator and the fixing belt, the fixing nip through which the recording medium is conveyed;

a first holder holding a first lateral end of the fixing belt in an axial direction of the fixing belt;

a second holder holding a second lateral end of the fixing belt in the axial direction of the fixing belt, the second holder, together with the first holder, defining a holder interval provided between the first holder and the second holder in the axial direction of the fixing belt; and a lubricant supplying sheet sandwiched between the nip formation pad and the fixing belt at the fixing nip, the lubricant supplying sheet having a sheet span in the axial direction of the fixing belt, the sheet span being within the holder interval, wherein a maximum conveyance span of the fixing device for the recording medium of a maximum size usable with the fixing device is within the sheet span.

17. The image forming apparatus according to claim 16, wherein the lubricant supplying sheet is impregnated with a lubricant.

18. The image forming apparatus according to claim 16, wherein the nip formation pad includes a plurality of projections disposed in a plurality of rows disposed along the rotation direction of the fixing belt.

19. The image forming apparatus according to claim 18, further comprising:

a reinforcement inside a loop formed by the fixing belt to enhance a mechanical strength of the nip formation pad, wherein the projections contact the reinforcement.

* * * * *